United States Patent [19]

Pope

[11] Patent Number: 4,782,590

[45] **Date of Patent: * Nov. 8, 1988**

[54] PERSONAL GROOMING DEVICE

[76] Inventor: H. Maie' Pope, 511 W. Melrose St., #104, Chicago, Ill. 60657

[ * ] Notice: The portion of the term of this patent subsequent to May 7, 2002 has been disclaimed.

[21] Appl. No.: 731,122

[22] Filed: Jul. 15, 1985

[51] Int. Cl.[4] ..... B26B 21/00

[52] U.S. Cl. ..... 30/50; 30/30; 30/32; 30/49

[58] Field of Search ..... 30/30, 32, 50, 85, 49

[56] References Cited

U.S. PATENT DOCUMENTS 2,127,010 8/1938 Sampson ..... 30/32 X 3,488,764 1/1970 Welsh ..... 30/32 X 3,919,769 11/1975 Horn ..... 30/30

*Primary Examiner*—Douglas D. Watts

*Attorney, Agent, or Firm*—Jerry A. Schulman

[57] ABSTRACT

A trimmer for eyebrows and other facial hair has two discrete, relatively thin blade segments held by a thermoplastic handgrip. The handgrip is formed in an angled or "bent" configuration. The exposed, longitudinally extending edges of the blade segments are honed or otherwise sharpened and are used to position one such blade segment to sever selected facial hair while angling the other blade segment away from the face. The handgrip segments holding the blades are rounded or radiused proximate each said blade segment. Multiple blade segments may also be used.

5 Claims, 2 Drawing Sheets

PERSONAL GROOMING DEVICE

BACKGROUND OF THE INVENTION

This application relates generally to the field of cosmetic grooming aids and devices and, more particularly, to an implement for shaping and trimming eyebrows.

The present invention is related to the invention disclosed in my application, Ser. No. 551,352, filed Nov. 14, 1983, and issued May 7, 1985 as U.S. Pat. No. 4,514,903.

Beauticians have long face inherent difficulties presented when trimming and shaping the eyebrows of their customers. Use of tweezers to pluck unwanted hairs is old and well known, but his method is extremely time-consuming and causes a significant amount of pain and discomfort. A preferred manner of trimming is to sever the hairs rather than to pluck them.

One difficulty in trimming and shaping brow hairs is the need to use a trimming device with extremely sharp cutting surfaces to sever the hairs of the brow while avoiding contact with the soft, easily cut skin of the face. Another reason such difficulty obtains is the location of the brows in close proximity to the eyes, and the care which must be exercised to avoid injurious contact with the eyelid or the eye itself. Yet another problem is encountered in making such a trimmer small enough to be maneuvered around the eyes and brows, yet shaped to allow the trimmer to be easily and firmly held and effectively manipulated.

Prior trimming devices of which I am aware do not fully meet these problems. For example, straight razor blades are commonly used for brow trimming even through such blades typically have extended straight cutting egdes which are long relative to the size of the brow and/or eyes, frequently requiring the razor blade to be angled away from the face when following a brow's contour or the contour of the face itself. This moves the cutting edge of the razor blade to a position which does not parallel the brow and makes it difficult to achieve a smooth, continuous cut. Maneuvering the blade to bring one corner of the cutting edge in contact with the brow may angle the other corner of the cutting edge in a position to inadvertently cut the hand or finger of the user or, if moved suddenly, to cut the face itself.

Many such straight razor blades are double edged, making manipulation of the blade even more hazardous. It is, therefore, the straightness and size of the blade and the length of the cutting edge which make the blade manifestly ill-suited for trimming eyebrows. On the other hand, even though the size and straightness of the blade cause problems, the sharpness of the blade and the ease with which the relatively limp and yielding eyebrow hairs may be cut by it, give the use of a razor or razor-like cutting edge particular utility.

The foregoing problems are exacerbated when prior trimmers are manipulated by the user, rather than by a beautician. The user relies principally upon observing his or her image in a mirror to guide the trimming operation and with the disadvantages discussed hereinabove, it is often the case that the user's hand, in which the razor is placed, itself blocks a clear view of the brow. Another problem to be overcome is the fact that the user is working with a mirror image, making manipulation of prior trimming devices less certain and making any mistake or potential mistake more serious.

The need, therefore, exists for a cutting or trimming implement preserving the utility of a razor-like edge, yet of a size and shape to allow the easy and effective manipulation of the cutting edge in order to effectively and conveniently trim a brow. These, and further objects of the present invention will better be understood by consideration of the accompanying drawings, wherein:

DETAILED DESCRIPTION OF THE INVENTION

An eyebrow trimmer is formed into distinct segments, with each segment formed at an angle to the immediately contigous segment. The trimmer has a pair of blades, one such blade positioned in each of the outermost segments. Each blade has an exposed edge which is ground, honed, or otherwise formed into a cutting edge of razor-like sharpness.

In a preferred embodiment of the invention, there are three such continuous segments, the central segment of which, a finger-grip portion, is devoid of any cutting edge, and is formed and shaped to allow easy manipulation of the cutting edges of the blades on the remaining outermost segments. The central segment has a gripping surface, such as raised ribs, to aid the user in keeping a firm grip during trimming.

DETAILED DESCRIPTION OF THE DRAWINGS

Figure 1:
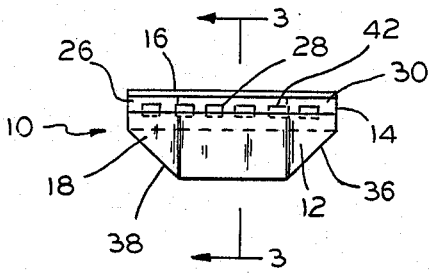
FIG. 1 is a front elevation of one embodiment of a device illustrating the invention disclosed herein.

Referring now to FIG. 1, the numeral 10 indicates generally a first preferred embodiment of an implement constructed according to the above-disclosed aspects of the present invention. As seen in FIG. 1, implement 10 has a handgrip portion 12 and a cutting edge or blade 14. As described hereinabove, blade 14 is preferably formed from a long, relatively narrow metal strip having a pair of longitudinally opposed and extending edges 16 and 18. In the embodiment herein shown, at least edge 16 is ground, honed, or otherwise formed to produce a razor-like edge.

Figure 2:
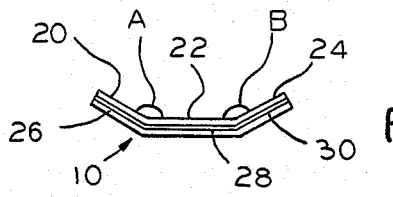
FIG. 2 is a top view of the device shown in FIG. 1.

In FIG. 2, a top view of implement 10, handgrip 12 is shown as formed from three contiguous and integral segments 20, 22, and 24, with central segment 22 meeting its contiguous partners 20 and 24 at angles A and B, respectively. In like fashion, cutting blade 14 is similarly formed wilth segments 26, 28, and 30 in a configuration which closely matches that of handgrip 12.

Figure 3:
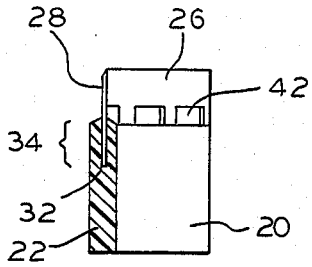
FIG. 3 is a view along lines 3—3 of FIG. 1.

In FIG. 3, a view along lines 3—3 of FIG. 1, implement 10 is shown in section illustrating the relative bend of cutting blade segment 26 with respect to segment 28.

In like fashion, the relative bend of handgrip segment 20 with respect to segment 22 is also illustrated.

Also shown in FIG. 3 is a preferred manner of securing cutting blade 14 to handgrip 12 by embedding edge 18 of blade 14 within a channel 32 formed along segment 20, 22 and 24 of handgrip 12 and sized to closely fit a sufficiently deep segment 34 of cutting blade 14 to hold cutting blade 14 within handgrip 12 in a mechanical or friction fit. Glues, cements, or mechanical fasteners may also be used to secure blade 14 to handgrip 12.

As further seen in FIG. 1, handgrip 12 may be shaped or trimmed as at 36 and 38, leaving central segment 22 fully extending. It is contemplated that a user, when manipulating or guiding implement 10 will find it convenient and comfortable to guide implement 10 by pressing a finger along edges 36 and 38 and also partially within the bend formed by handgrip segments 20, 22 and 24.

Mounting a sharpened razor-like metal strip in a plastic or plastic-like holder is well known. However, such holders do not, to my knowledge, teach the angling of continuous or adjacent segments in order to expose the cutting edge for trimming purposes and to angle the segment containing cutting edges away one from the other to more conveniently and effectively limit contact of the cutting edge only to those segments of the face or brows sought to be trimmed. As an example, it is known to mount razor blades for the shaving of facial hair into plastic carriers or holders, but in unsegmented configurations.

Figure 4:
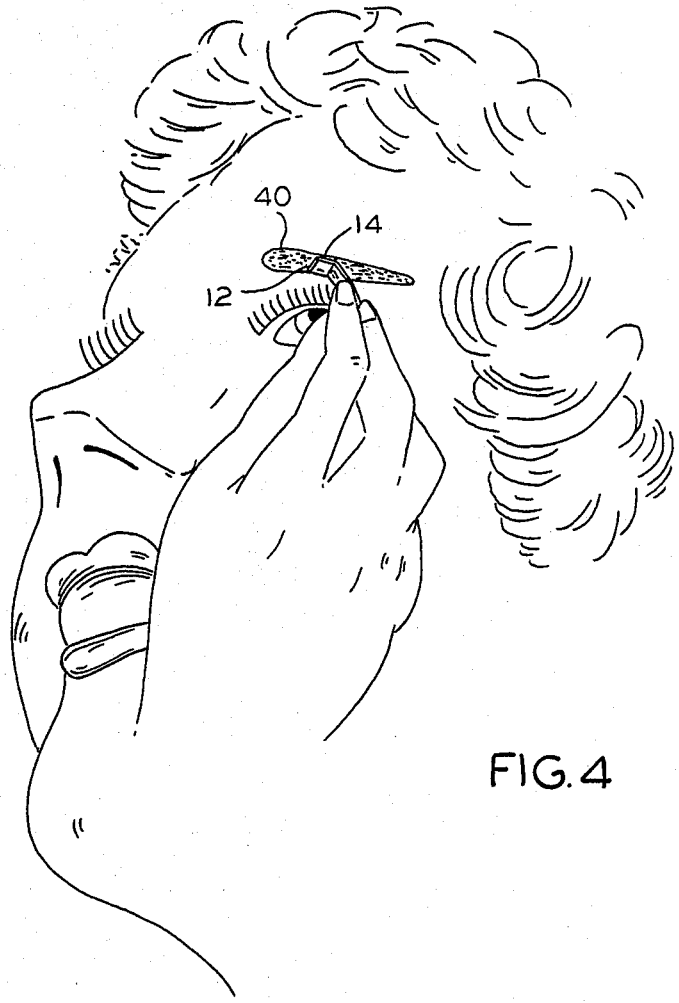
FIG. 4 is an illustration demonstrating use of the embodiment of FIG. 1.

Referring now to FIG. 4, use of one preferred embodiment hereinabove discussed is illustrated. The user may grip handgrip 12 to angle a portion of blade 14 in position to trim and contact brow 40 along its uppermost edge thereof, while the remaining segments of blade 14 are angled away from the user's face. Implement 10 may also be reversed or inserted when used, for example, on different sides of the face or when the implement is shifted from one hand to the other.

As seen in FIGS. 1 and 3, a series of longitudinally-spaced apertures 42 may be formed along blade 14 to lighten blade 14 and to provide courses for cleansing water to flush away brow hair and other material removed during the trimming process.

Another preferred embodiment would sharpen cutting edge 16 only at wing segments 26 and 30 of blade 14. This would be done where the central segment 28 of blade 14 would not be intended for use during cutting and trimming, and could be left dull.

In its preferred embodiment, angles A and B are identical, producing an implement which is symmetrically formed. Angles A and B may differ, however, if desired.

As presently contemplated, fingergrip 12 may be formed from a relatively easily molded thermoplastic material which when cast or molded, and thereafter cooled or cured. Insertion of blade 14 to fingergrip 12 may be carried out during the molding process or thereafter, as the practicalities and economies of the manufacturing process dictate. Whem fingergrip 12 is cast or molded around metal strip 14, apertures 42 form sites for attachment wherein the material used for form fingergrip 12 flows there through prior to setting or curing. Although the present implement is intended for use as a unitary structure which could be discarded when blade 14 dulls, it is also contemplated that a more elaborate structure may be utilized for fingergrip 12 to enable removal of blade 14 and replacement by a fresh blade. Such structure may also allow both edges 16 and 18 to be sharpened, and to allow blade 14 to be removed and reversed when one such edge dulls.

Figure 5:
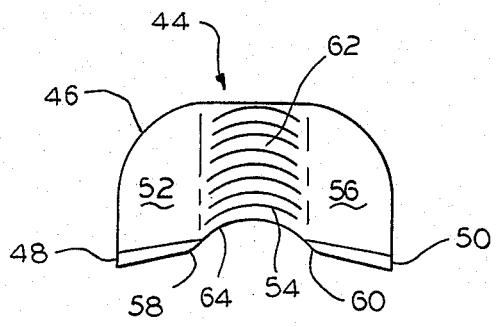
FIG. 5 is a front view of a second embodiment of the present invention.
Figure 6:
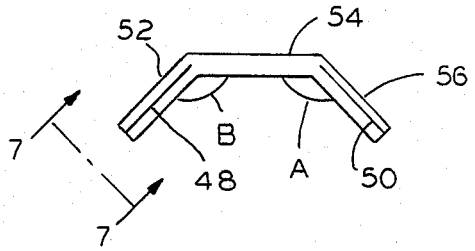
FIG. 6 is a bottom view of the device shown in FIG. 5.

A second embodiment of the present invention is shown in FIGS. 5, 6, 7, and 8 hereto. As seen in FIGS. 5 and 6, implement 44 includes a body 46 into which discrete blade segments 48 and 50 are set. Body 46 is divided into three continuous segments 52, 54, and 56, with blade segment 48 mounted along the lowermost edge of wing 52, and blade segment 50 mounted along the lowermost edge of wing 56.

Central body segment 54 is devoid of any blade segment, and thus provides a central fingergrip with no cutting blade segment along its lowermost edge, and may be contoured, or have gripping ribs formed thereon, as seen at 62 in FIG. 5, to provide a secure fingergrip. Body segment 54 may also be arched or contoured, as at 64 of FIG. 5, to enable better view of blades 48 and 50 during use.

Figure 7:
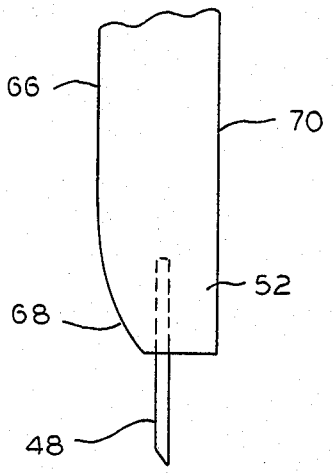
FIG. 7 is a view taken along 7—7 of FIG. 6.

As seen in FIG. 7, rear wall 66 of wing 52 is rounded or radiused, at 68, to provide cleaner access to blade 48, and to avoid the "drag" which may occur if a sharpened corner were to dig into a user's skin during trimming. A preferred embodiment has blade 48 positioned intermediate rear wall 66 and front wall 70, with blade 48 being closed to radius 68 than to front wall 70. As seen at 72 of FIG. 7, blade 48 may include a row of apertures similar to those shown in FIGS. 1 and 3.

While the cutting blades described herein have been depicted as single edges, I am aware of the use of double-or twin-blade arrangements wherein a pair of closely-spaced cutting edges are used to trim facial hair. It is contemplated that such an arrangement may, under some circumstances, be advantageous for use in the present invention.

As seen at 58 and 60 of FIG. 5, the innermost edges of blades 48 and 50 may be rounded or contoured to avoid the creation of a sharp-pointed blade corner.

Figure 8:
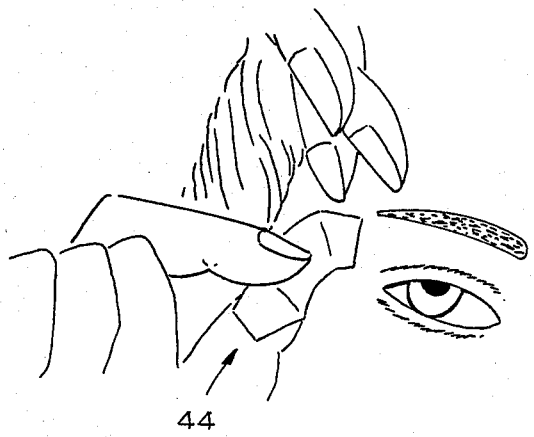
FIG. 8 is an illustration demonstrating use of the embodiment of FIG. 5.

Use of the second preferred embodiment is illustrated in FIG. 8. The shape of body segments 52, 54 and 56 positions blade segment 48 away from a user's face while blade 50 is being used as shown.

As with the first embodiment discussed hereinabove, angles A and B of FIG. 6 may be equal or unequal, as desired. In addition, as described hereinabove, blade segments 48 and 50 may be replaceable or reversibly insertable, as desired.

The foregoing construction is lighter in weight and more easily manipulated than the prior art razors discussed herein.

While the foregoing has presented certain specific embodiments of the present invention, it is to be understood that these embodiments have been presented by way of example only. It is expected that others will perceive variations which, while differing from the foregoing, do not depart from the spirit and scope of the invention as herein described and claimed.

What is claimed is:

1. A cutter for trimming and shaping facial hair, said cutter comprising:

first and second discrete, relatively narrow metal blades, each said blade having a pair of longitudinally-extending and opposed edges, the first of said blade edge being honed or sharpeded; and a handgrip to hold said blades, said handgrip having a central segment and a pair of longitudinally-extending wings integral with said central segment, said wings formed by inclining or angling said handgrip side edges one toward the other with respect to said central segment, each said wing having a top edge formed from a segment of said handgrip top edge, said wing top edges being non-parallel one to the other;

each said handgrip wing segment engaging one said blade at each said second blade edge and over a portion of each said blade towards each said first blade edge, each said first or sharpened blade edge remaining exposed when said blade is engaged by said handgrip, said blades secured to said handgrip at each said wing top edge segment, said central segment devoid of any cutting blade, each said blade held in one said winged segment top edge in an angled or inclined attitude with respect to said central handgrip segment and in a non-parallel relationship one to the other.

2. The apparatus as recited in claim 1 wherein said wings meet said central segment at identical angles.

3. The apparatus as recited in claim 1 wherein said metal blade has a plurality of apertures spaced longitudinally therealong with at least a portion of each said plurality of apertures overlapped by one said wing segment.

4. The apparatus as recited in claim 1 wherein said central handgrip segment includes means for gripping said cutter with one's fingers, said gripping means including contouring said central handgrip segment and forming thereon a plurality of raised or ribbed elements.

5. The apparatus as recited in claim 1 wherein each said wing has a front wall and a rear wall; and one said blade is positioned on each said wing closer to said rear wall than said front wall and extending generally perpendicularly therefrom.

* * * * *